US008268058B2

(12) United States Patent
Wu et al.

(10) Patent No.: US 8,268,058 B2
(45) Date of Patent: Sep. 18, 2012

(54) HIGH-PERFORMANCE LABYRINTH TYPE AIR TREATMENT APPARATUS

(76) Inventors: Fu-Chi Wu, Northridge, CA (US); Steven Wu, Northridge, CA (US)

( * ) Notice: Subject to any disclaimer, the term of this patent is extended or adjusted under 35 U.S.C. 154(b) by 438 days.

(21) Appl. No.: 12/591,272

(22) Filed: Nov. 16, 2009

(65) Prior Publication Data

US 2011/0113963 A1 May 19, 2011

(51) Int. Cl.
*B03C 3/36* (2006.01)

(52) U.S. Cl. ..... 96/63; 95/78; 96/64; 96/96; 96/98

(58) Field of Classification Search ..... 96/63, 75–79, 96/86, 87, 96–100, 60, 62, 64; 95/78
See application file for complete search history.

(56) References Cited

U.S. PATENT DOCUMENTS 3,678,653 A * 7/1972 Buschman ..... 96/66
4,289,504 A * 9/1981 Scholes ..... 95/73
4,472,174 A * 9/1984 Chuan ..... 95/58
5,215,558 A * 6/1993 Moon ..... 96/62
5,484,473 A * 1/1996 Bontempi ..... 96/65
6,312,507 B1 * 11/2001 Taylor et al. ..... 96/19
2008/0078291 A1 * 4/2008 Daukant ..... 95/69

FOREIGN PATENT DOCUMENTS

JP 4-135661 A * 5/1992 ..... 96/96

* cited by examiner

*Primary Examiner* — Richard L Chiesa
(74) *Attorney, Agent, or Firm* — Rosenberg, Klein & Lee

(57) ABSTRACT

A high-performance labyrinth type air treatment apparatus includes a positively (negatively) charged dust collector mounted in an air passage inside a shell, the positively (negatively) charged dust collector having positively (negatively) charged dust collecting panels arranged in such a manner that a labyrinth-like detoured air path is defined through the positively (negatively) charged dust collector, an air ionization control means having discharge/emitting terminals arranged in the labyrinth-like detoured air path, and an electric fan for causing flowing of air through the positively (negatively) charged dust collector so that negatively (positively) charged heteroparticles carried in currents of air flowing through the labyrinth-like detoured air path are forced, to strike repeatedly against the positively (negatively) charged dust collecting panels and then effectively adhered to the positively (negatively) charged dust collecting panels, achieving extremely high air purification.

12 Claims, 4 Drawing Sheets

HIGH-PERFORMANCE LABYRINTH TYPE AIR TREATMENT APPARATUS

BACKGROUND OF THE INVENTION

1. Field of the Invention

The present invention relates to air treatment apparatus and more particularly, to a high-performance labyrinth type air treatment apparatus, which comprises a positively (negatively) charged dust collector mounted in an air passage of a shell, the positively (negatively) charged dust collector having a plurality of positively (negatively) charged dust collecting panels arranged at two opposite sides in a staggered manner so that a detoured air path is defined by the positively (negatively) charged dust collecting panels, an air ionization control means having discharge/emitting terminals arranged in the detoured air path and an electric fan mounted in the air passage for causing flowing of air through the positively (negatively) charged dust collector. During operation of said at least one electric fan, currents of air are induced to flow through said detoured air path, negatively (positively) charged heteroparticles carried in currents of air flowing through said detoured air path are forced, subject to physical inertial motion principle and change of flowing direction of the intake flow of air in the detoured air path, to strike repeatedly against said positively (negatively) charged dust collecting panels so that said negatively (positively) charged heteroparticles are adhered to said positively (negatively) charged dust collecting panels, achieving extremely high air purification.

2. Description of the Related Art

Following fast business and industry development, waste gas discharged from factories and motor vehicle pollute the air, threatening the health of human beings. The air around us contains invisible harmful substances. High concentration of pollutants such as micro particles of car waste gas, tiny hairs, micro fibers and industrial waste gas and odor substances are floating in air around the floor, table top and desk top. These harmful substances will fall to the floor, table top and desk top subject to the effect of gravity when it is still. When a wind is induced as we are walking or when a natural wind occurs, the harmful substances deposited on the floor, table top or desk top will be moved with the wind into the air, and people within this area will breathe in these harmful substances, causing diseases.

Many different air purifiers are known and commercially available. These commercial air purifiers commonly use one or a number of positively or negatively charged static dust collection panels on the inside or outside of the housing for adhering dust particles, thereby purifying the air. Heteroparticles carried in air can be adhered to the positively or negatively charged static dust collection panels only when they are kept in proximity to the positively or negatively charged static dust collection panels or the flow of air carrying the heteroparticles is flowing slowly.

During operation of a conventional air purifier, the intake flow of air that is drawn into the air inlet of the housing flows rapidly through a straight air passage to the exhaust port. Because the intake flow of air goes rapidly through the straight air passage in the air purifier, most heteroparticles carried by the intake flow of air are kept away from the positively or negatively charged static dust collection panels, i.e., a big amount of the heteroparticles escape from the attraction of the positively or negatively charged static dust collection panels. Therefore, conventional air purifiers have a low performance. Further, the meshed filter elements used in conventional air purifiers can remove dust particles of particle size greater than 0.1 μm. Therefore, conventional air purifiers are not satisfactory in function. Further, the meshed filter elements of conventional air purifiers are usually cleaned or replaced after several months in use. This does not mean good air quality but just because of a poor filtering effect.

SUMMARY OF THE INVENTION

The present invention has been accomplished under the circumstances in view. It is the main object of the present invention to provide a high-performance labyrinth type air treatment apparatus, which comprises a positively (negatively) charged dust collector mounted in an air passage of a shell, the positively (negatively) charged dust collector having a plurality of positively (negatively) charged dust collecting panels arranged at two opposite sides in a staggered manner so that a detoured air path is defined by the positively (negatively) charged dust collecting panels, an air ionization control means having discharge/emitting terminals arranged in the detoured air path and an electric fan mounted in the air passage for causing flowing of air through the positively (negatively) charged dust collector. During operation of said at least one electric fan, currents of air are induced to flow through said detoured air path, negatively (positively) charged heteroparticles carried in currents of air flowing through said detoured air path are forced, subject to physical inertial motion principle and change of flowing direction of the intake flow of air in the detoured air path, to strike repeatly against said positively (negatively) charged dust collecting panels so that said negatively (positively) charged heteroparticles are adhered to said positively (negatively) charged dust collecting panels, achieving extremely high air purification.

Further, each dust collecting panel can have a plurality of flow disturbing ribs protruded from at least one of two opposite sides thereof to disturb the airflow to increase the number of times in which said negatively (positively) charged heteroparticles carried in said currents of air strike repeatedly against said positively (negatively) charged dust collecting panels.

BRIEF DESCRIPTION OF THE DRAWINGS

FIG. 2-1 is a schematic sectional view, showing another installation example of the air ionization control means in the air passage of the shell according to the first embodiment of the present invention.

FIG. 4-1 is a schematic sectional view, showing another installation example of the air ionization control means in the air passage of the shell according to the second embodiment of the present invention.

DETAILED DESCRIPTION OF THE PREFERRED EMBODIMENT

Figure 1:
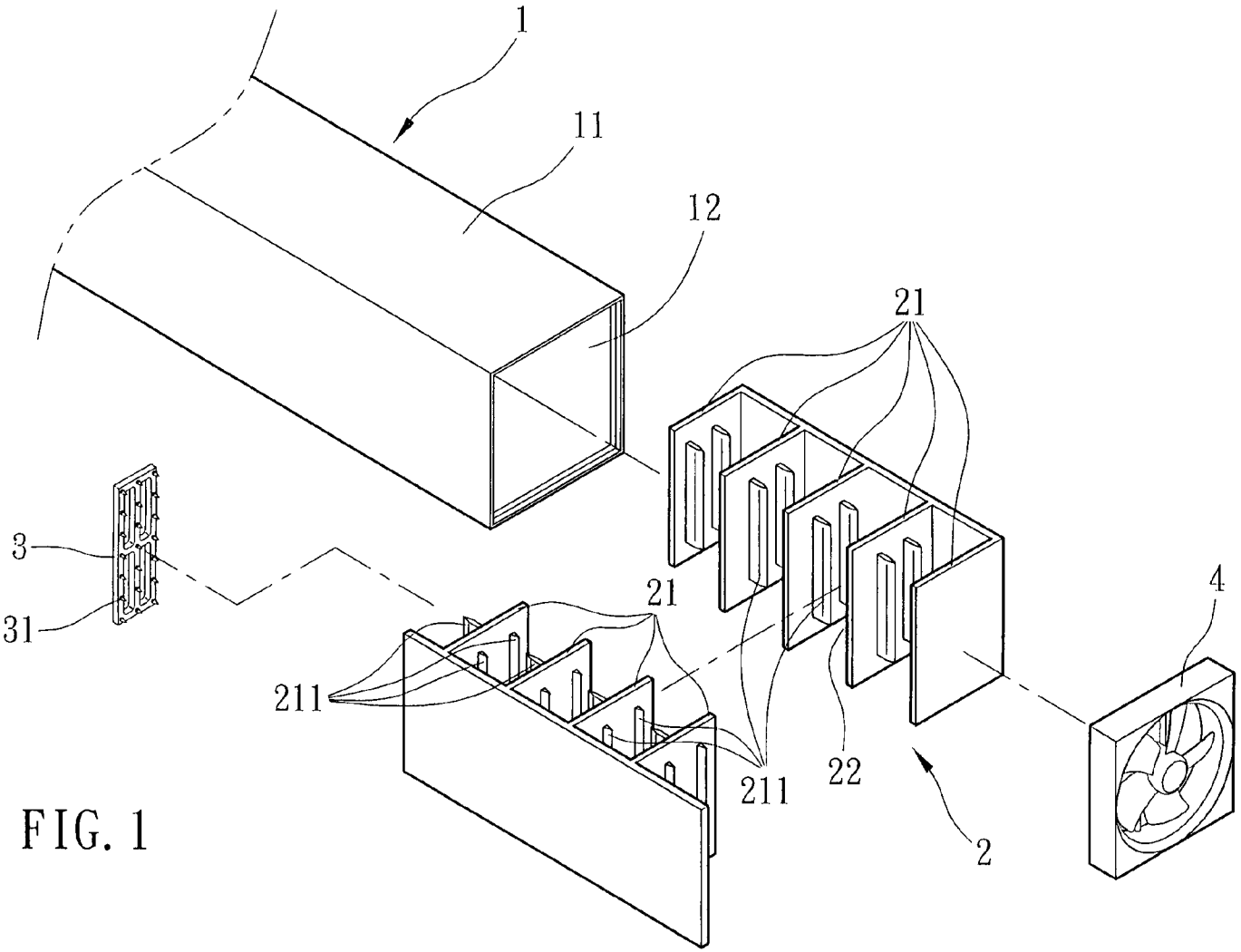
FIG. 1 is an exploded view of a high-performance labyrinth type air treatment apparatus in accordance with a first embodiment of the present invention.
Figure 2:
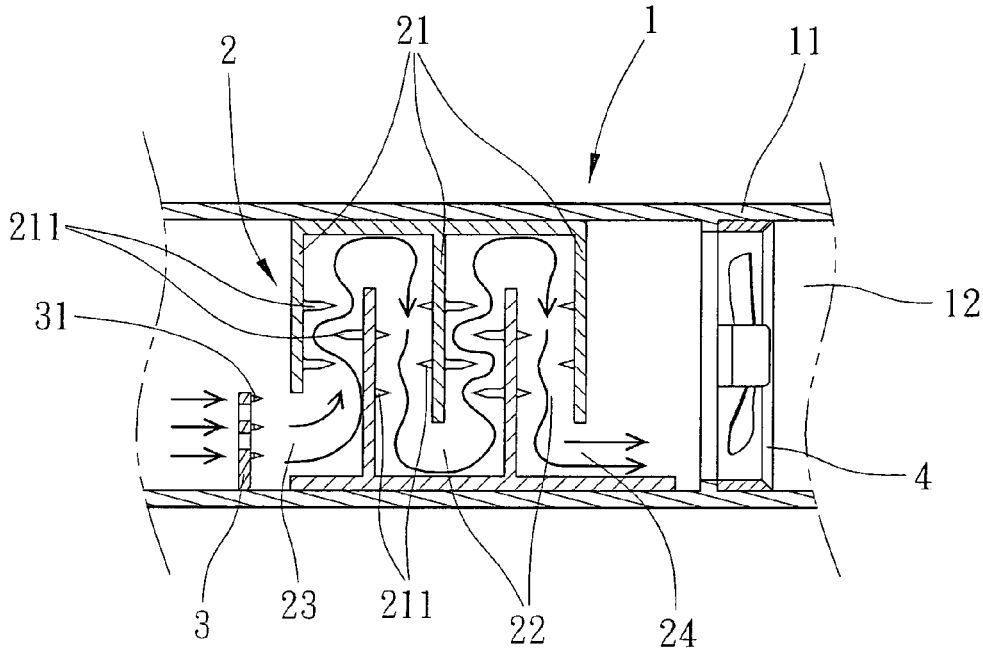
FIG. 2 is a schematic sectional assembly view of the high-performance labyrinth type air treatment apparatus in accordance with the first embodiment of the present invention.
Figures 1, 4:
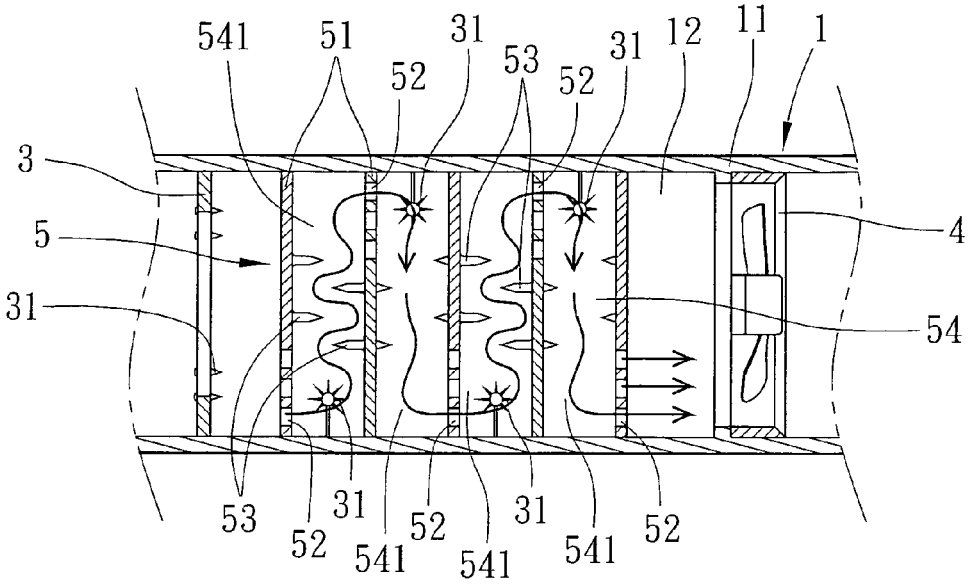
Figures 1, 2:
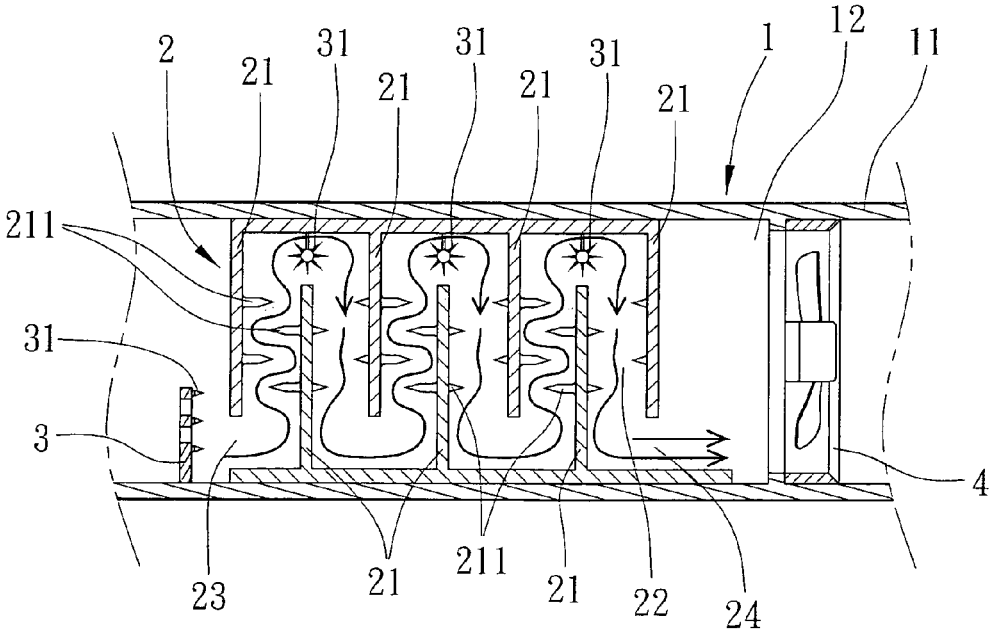

Referring to FIGS. 1 and 2, a high-performance labyrinth type air treatment apparatus 1 in accordance with a first embodiment of the present invention is shown comprising a shell 11 defining therein an air passage 12 and a dust collector 2 mounted in the air passage 12. The dust collector 2 comprises a plurality of dust collecting panels 21 arranged at two opposite sides in a staggered manner between an air inlet 23 and an air outlet 24, thereby defining a detoured air path 22. The dust collector 2 has a discharge/emitting terminals 31 of an air ionization control means 3 and an electric fan 4 respectively installed in the air inlet 23 and the air outlet 24. The air ionization control means 3 can be an anion (cation) generator or positive static high-voltage discharge generator. According to this embodiment, the air ionization control means 3 is an anion (cation) generator. The discharge/emitting terminals 31 of the air ionization control means 3 is mounted near the air inlet 23 at one end of the dust collector 2. The electric fan 4 is mounted in the air outlet 24 of the dust collector 2 and operated to suck in air from the dust collector 2. During operation of the electric fan 4, currents of air are drawn through the air inlet 23 into the detoured air path 22 toward the air outlet 24. At this time, heteroparticles carried in the induced currents of air are negatively (positively) charged by the discharge/emitting terminals 31 of the air ionization control means 3. Subject to the suction force produced by the electric fan 4, negatively (positively) charged heteroparticles carried in the intake flow of air that flows through the detoured air path 22 are forced, subject to physical inertial motion principle and change of flowing direction of the intake flow of air in the detoured air path 22, to strike repeatly against the positively (negatively) charged dust collecting panels 21 so that a almost all the negatively (positively) charged heteroparticles are adhered to the positively (negatively) charged dust collecting panels 21, achieving extremely high air purification. In order to increase the number of times in which the negatively (positively) charged heteroparticles carried in the intake flow of air strike repeatly against the positively (negatively) charged dust collecting panels 21, each dust collecting panel 21 can be made having a plurality of flow disturbing ribs 211 protruded from the front side, rear side or both the front and rear sides thereof. By means of the arrangement of the flow disturbing ribs 211 on each dust collecting panel 21, the number of times in which the negatively (positively) charged heteroparticles carried in the intake flow of air passing through the detoured air path 22 strike repeatly against the positively (negatively) charged dust collecting panels 21 is greatly increased so that the negatively (positively) charged heteroparticles carried in the intake flow of air passing through the detoured air path 22 are heavily adhered to the positively (negatively) charged dust collecting panels 21, achieving an extremely high air purification effect. Further, the discharge/emitting terminals (or tungsten wires) 31 of the air ionization control means (anion or cation generator or positive static high-voltage discharge generator) 3 can be arranged in the detoured air path 22, enhancing the air ionization effect (see FIG. 2-1).

Figure 4:
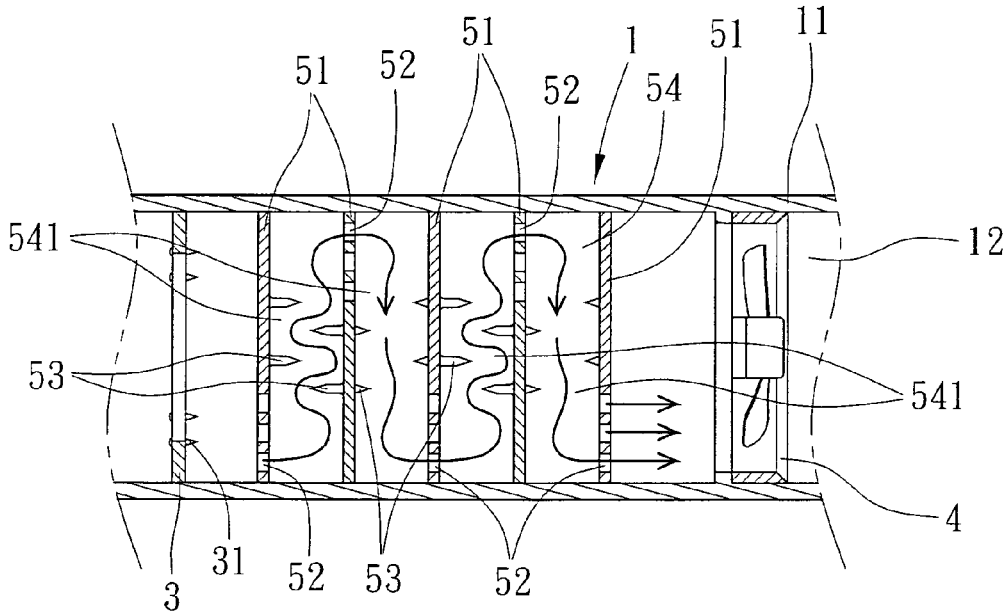
FIG. 4 is a schematic sectional assembly view of the high-performance labyrinth type air treatment apparatus in accordance with the second embodiment of the present invention.
Figure 3:
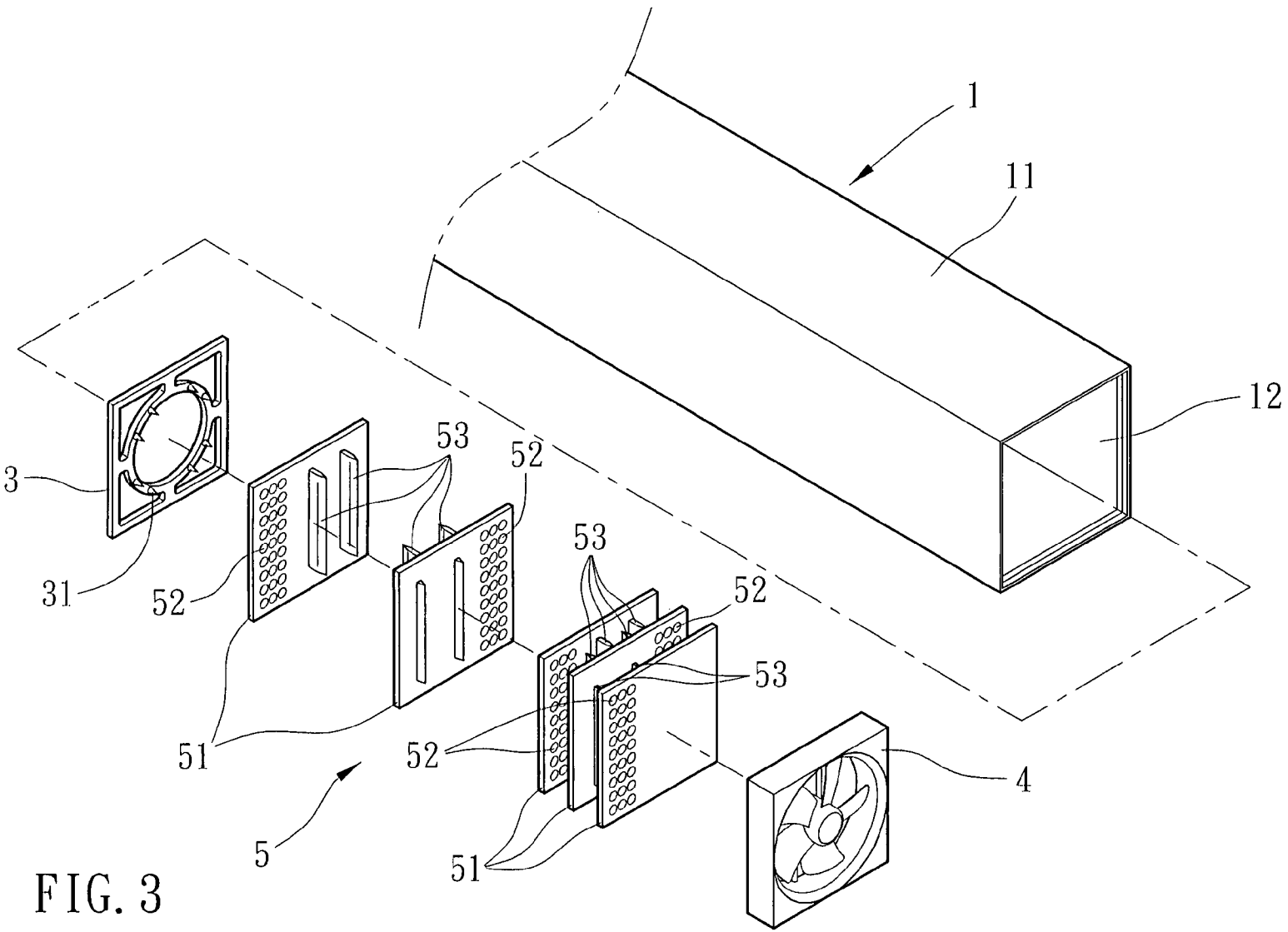
FIG. 3 is an exploded view of a high-performance labyrinth type air treatment apparatus in accordance with a second embodiment of the present invention.

FIGS. 3 and 4 show a high-performance labyrinth type air treatment apparatus 1 in accordance with a second embodiment of the present invention. According to this second embodiment, the high-performance labyrinth type air treatment apparatus 1 comprises a shell 11 defining therein an air passage 12, an air ionization control means 3 and an electric fan 4 mounted in the air passage 12 inside the shell 11, and a dust collector 5 mounted in the air passage 12 between the air ionization control means 3 and the electric fan 4. The dust collector 5 comprises a plurality of positively (negatively) charged dust collecting panels 51 arranged in parallel and a chamber 541 defined between each two adjacent positively (negatively) charged dust collecting panels 51. Each positively (negatively) charged dust collecting panel 51 comprises a multiple rows of air vents 52 arranged near the left or right side thereof, and a plurality of flow disturbing ribs 53 on the front side, rear side or both the front and rear sides thereof. The positively (negatively) charged dust collecting panels 51 are so arranged that the air vents 52 of the positively (negatively) charged dust collecting panels 51 define a detoured air path 54 through the dust collector 5 between the air ionization control means 3 and the electric fan 4. Further, each positively (negatively) charged dust collecting panel 51 can comprise a plurality of flow disturbing ribs 53 protruded from the front side, rear side or both the front and rear sides thereof. Subject to the effect of the flow disturbing ribs 53, the number of times in which the negatively (positively) charged heteroparticles carried in the intake flow of air strike repeatly against the positively (negatively) charged dust collecting panels 51 is greatly increased, enhancing the air purification performance of the high-performance labyrinth type air treatment apparatus 1. Further, the discharge/emitting terminals (or tungsten wires) 31 of the air ionization control means (anion or cation generator or positive static high-voltage discharge generator) 3 can be arranged in the detoured air path 54 and the main unit of the air ionization control means (anion or cation generator or positive static high-voltage discharge generator) 3 can be mounted outside the air passage 12 of the shell 11, for engineering consideration (see FIG. 4-1).

In the aforesaid embodiments, one electric fan 4 is mounted in the air passage 12 inside the shell 11 to suck in air. In actual practice, air suction or exhausting means may be used subject to the design of the air treatment equipment. Further, multiple positively (negatively) charged dust collector 2 or 5 may be arranged in the air treatment equipment or the air passage 12 of the shell 11 subject to the characteristics of the local air, assuring best performance to provide highly purified air for breathing.

Further, the multiple positively (negatively) charged dust collector 2 or 5 can be used in the central air conditioning system of a building, or a motor vehicle, ship, home building, church, temple, shopping center, classroom, factory, office or any public places. The multiple positively (negatively) charged dust collector 2 or 5 can also be made in a mobile design for use by a firefighter, soldier or policeman, helping breathing in purified air.

Further, the positively (negatively) charged dust collecting panels 51 of the multiple positively (negatively) charged dust collector 2 or 5 can be individually installed. Alternatively, the positively (negatively) charged dust collecting panels 51 of the multiple positively (negatively) charged dust collector 2 or 5 can be made integrally in the form of a module to facilitate installation.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A high-performance labyrinth air treatment apparatus, comprising:

a shell defining therein an air passage;

a positively or negatively charged dust collector mounted in said air passage, said positively or negatively charged dust collector comprising a plurality of positively or negatively charged dust collecting panels arranged at two opposite sides in a staggered manner, a detoured air path defined by said positively or negatively charged dust collecting panels;

an air ionization control means, said air ionization control means comprising discharge/emitting terminals arranged in said detoured air path; and at least one electric fan mounted in said air passage for causing flowing of air through the charging zone of discharge/emitting terminals of air ionization control means and said positively or negatively charged dust collector;

wherein during operation of said at least one electric fan, currents of air are induced to flow through said detoured air path, heteroparticles carried in the induced currents of air are charged with negative or positive charges by said discharge/emitting terminals of said air ionization control means and then negatively or positively charged heteroparticles carried in the induced currents of air flowing through said detoured air path are forced, subject to physical inertial motion principle and change of flowing direction of the intake flow of air in the detoured air path, to strike repeatedly against said positively or negatively charged dust collecting panels so that said negatively or positively charged heteroparticles are adhered to said positively or negatively charged dust collecting panels, achieving extremely high air purification.

2. The high-performance labyrinth air treatment apparatus as claimed in claim 1, wherein each said dust collecting panel comprising a plurality of flow disturbing ribs protruded from at least one of two opposite sides thereof to disturb the airflow to increase the number of times in which said negatively or positively charged heteroparticles carried in said currents of air strike repeatedly against said positively or negatively charged dust collecting panels.

3. The high-performance labyrinth air treatment apparatus as claimed in claim 1, wherein multiple positively or negatively charged dust collectors can be used subject to the characteristics of the local air to achieve best performance and to obtain highly purified air.

4. The high-performance labyrinth air treatment apparatus as claimed in claim 1, wherein said air ionization control means is an anion or cation generator.

5. The high-performance labyrinth air treatment apparatus as claimed in claim 1, wherein said air ionization control means is a positive static high-voltage discharge generator.

6. The high-performance labyrinth air treatment apparatus as claimed in claim 1, wherein said air ionization control means has the discharge/emitting terminals thereof arranged in said detoured air path and the main unit thereof arranged outside said air passage of said shell to enhance air ionization performance.

7. A high-performance labyrinth air treatment apparatus, comprising:

a shell defining therein an air passage;

a positively or negatively charged dust collector mounted in said air passage, said positively or negatively charged dust collector comprising a plurality of positively or negatively charged dust collecting panels arranged in parallel and defining a chamber between each two adjacent positively or negatively charged dust collecting panels, each said positively or negatively charged dust collecting panels having an array of air vents disposed near left or right side thereof, said positively or negatively charged dust collecting panels being so arranged that the air vents of said positively or negatively charged dust collecting panels defining a detoured air path extending through each chamber between each two adjacent positively or negatively charged dust collecting panels;

an air ionization control means, said air ionization control means comprising discharge/emitting terminals arranged in said detoured air path; and at least one electric fan mounted in said air passage for causing flowing of air through said positively or negatively charged dust collector;

wherein during operation of said at least one electric fan, currents of air are induced to flow through said detoured air path, negatively or positively charged heteroparticles carried in currents of air flowing through said detoured air path are forced, subject to physical inertial motion principle and change of flowing direction of the intake flow of air in the detoured air path, to strike repeatedly against said positively or negatively charged dust collecting panels so that almost all the said negatively or positively charged heteroparticles are adhered to said positively or negatively charged dust collecting panels, achieving extremely high air purification.

8. The high-performance labyrinth air treatment apparatus as claimed in claim 7, wherein each said dust collecting panel comprising a plurality of flow disturbing ribs protruded from at least one of two opposite sides thereof to disturb the airflow to increase the number of times in which said negatively or positively charged heteroparticles carried in said currents of air strike repeatedly against said positively or negatively charged dust collecting panels.

9. The high-performance labyrinth air treatment apparatus as claimed in claim 7, wherein the number of said positively or negatively charged dust collector can be increased or reduced subject to the characteristics of the local air to achieve best performance and to obtain highly purified air.

10. The high-performance labyrinth air treatment apparatus as claimed in claim 7, wherein said air ionization control means is an anion or cation generator.

11. The high-performance labyrinth air treatment apparatus as claimed in claim 7, wherein said air ionization control means is a positive static high-voltage discharge generator.

12. The high-performance labyrinth air treatment apparatus as claimed in claim 7, wherein said air ionization control means has the discharge/emitting terminals thereof arranged in said detoured air path and the main unit thereof arranged outside said air passage of said shell to enhance air ionization performance.

* * * * *